US007278783B1

(12) United States Patent
Hiranuma et al.

(10) Patent No.: US 7,278,783 B1
(45) Date of Patent: Oct. 9, 2007

(54) WRISTWATCH AND STRAP FOR TIMEPIECE

(75) Inventors: Haruki Hiranuma, Chiba (JP); Koremoto Takeda, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/655,657

(22) Filed: Jan. 19, 2007

(30) Foreign Application Priority Data

Feb. 10, 2006 (JP) ..... 2006-034205

(51) Int. Cl.
*A44C 5/00* (2006.01)

(52) U.S. Cl. ..... 368/282; 24/265 WS; 224/164

(58) Field of Classification Search ..... 368/281, 368/282; 24/265 WS; 224/164, 167, 168, 224/177

See application file for complete search history.

(56) References Cited

U.S. PATENT DOCUMENTS 4,414,719 A * 11/1983 Capolupo ..... 24/265 WS
5,483,505 A * 1/1996 Cartier ..... 368/282
6,238,083 B1 * 5/2001 Hirano et al. ..... 368/282
7,210,844 B2 * 5/2007 Hiranuma et al. ..... 368/282

* cited by examiner

*Primary Examiner*—Vit W Miska
(74) *Attorney, Agent, or Firm*—Adams & Wilks

(57) ABSTRACT

To provide a wristwatch capable of promoting operability of attaching and detaching an end-piece to and from a rod leg and capable of promoting handling performance in being brought to and from a storing place. A recess portion is formed at a back face of an end-piece of a strap. Through holes opposed to attaching holes of rod legs are respectively provided at side walls of the piece in a state of receiving the piece at a rod crotch between the rod leg of a case body continuous to each other. An attaching member including a fold back portion having pinching portions and capable of being elastically deformed in directions of increasing and reducing an interval therebetween and attaching shaft portions folded to bend from the two portions to be rotatably inserted into the holes is contained in a recess portion movably between a first position and a second position. A fixed shaft pinched by the portion when the member is arranged at the first position is provided at the recess portion to be shifted from a linear line connecting the through holes. The shaft portions are projected to outside of the piece by widening an interval between the portions by the shaft at the first position, and the shaft portions are immersed into the piece when the member is arranged at the second position by detaching the fold back portion from the shaft.

6 Claims, 5 Drawing Sheets

WRISTWATCH AND STRAP FOR TIMEPIECE

BACKGROUND OF THE INVENTION

1. Field of the Invention

The present invention relates to a wristwatch and a strap for a timepiece connected attachable and detachably to and from a case body thereof.

2. Description of the Prior Art

In a background art, there is known a wristwatch capable of attaching and detaching a strap to and from a case body without using a special tool (refer to, for example, registered Japanese Utility Model No. 3042321).

According to the wristwatch of registered Japanese Utility Model No. 3042321, an end-piece made of a metal of a strap received by a rod crotch of a case body is provided with two of curl portions remote from each other in a width direction of the piece, one of the curl portions is provided with an inclined face and a narrow width end of the inclined face is provided with a taper face, and a spring bar having a handle for operating the spring rod for being brought in and out to and from the two curl portions is rotatably held thereby. One end portion of the spring bar is always projected from the curl portion which does not include the inclined face.

Other end portion of the spring bar is made to be projected from and immersed to the curl portion having the inclined face by rotating the handle. That is, when the handle is rotated to be erected relative to the end piece, the handle is engaged with the taper face to be held in a contracted state, and the other end portion of the spring rod is immersed into the curl portion having the inclined face. Further, when the handle is rotated to move down to be in line with a back face of the end piece, the handle is engaged with the inclined face to be held in a widened state, and the other end portion of the spring bar is projected from the curl portion having the inclined face.

Therefore, the strap can be attached to the case body by containing the end-piece to the rod crotch while inserting the one end portion of the spring bar projected always into the hole of attaching one rod leg forming the rod crotch and projected from the case body, and moving down the erected handle under the state to thereby insert the other end portion of the spring bar into the hole of attaching the other rod leg opposed to the rod leg. In the attaching state, the handle is brought into a state of being elastically deformed, thereby, a state of being attached to the case body is held. Further, converse to the above-described attaching procedure, by erecting the handle moved down in a state of attaching the strap to the case back, after detaching the other end portion of the spring bar from the other rod leg, by skewedly drawing the end-piece from the rod crotch to thereby detach the one end portion of the spring bar from the one rod leg, the strap can be detached from the case body.

As described above, according to the technology of registered Japanese Utility Model No. 3042321, in attaching the strap, there is required time and labor of inserting the one end portion of the spring bar into the attaching hole of the one rod leg, thereafter, inserting the other end portion of the spring bar to the attaching hole of the other rod leg, and there is required inverse time and labor also in detaching the strap and therefore, it is troublesome to attach and detach the strap. Further, in a state of storing the strap detached from the case back, both of the two end portions of the spring bar are brought into a state of being projected and therefore, there is a concern that when the strap is brought in and out to and from a storing place, the strap is caught by other member.

SUMMARY OF THE INVENTION

It is an object of the invention to provide a wristwatch, and a strap for a timepiece capable of promoting operability of attaching and detaching an end-piece to and from a rod leg and capable of promoting handling performance in bringing in and out a strap to and from a storing place.

In order to resolve the above-described problem, a wristwatch according to the invention is a wristwatch in which a strap is attachably and detachably connected to a case body projected with rod legs having attaching holes and formed with a rod crotch between the contiguous rod legs, wherein a recess portion is formed at a back face of an end-piece of the strap received by the rod crotch to be able to be brought thereto and therefrom, through holes opposed to the attaching holes are respectively provided at side walls of the end-piece disposed on both sides of the recess portion in a state of receiving the end-piece at the rod crotch, an attaching member including a fold back portion having pinching portions opposed to each other and capable of being deformed elastically in a direction of widening and a direction of narrowing an interval between the pinching portions and attaching shaft portions rotatably inserted into the through holes by being folded to bend from the two pinching portions in directions of being remote from each other is contained at the recess portion movably between a first position and a second position by rotating the attaching member, a fixed shaft to and from which the fold back portion is attached and detached is provided at the recess portion to be shifted from a linear line connecting the two through holes, and when the attaching member is arranged at the first position, front end portions of the attaching shaft portions are projected to outside of the end-piece by widening the interval between the pinching portions by the fixed shaft pinched by the pinching portions of the fold back portion, and when the attaching member is arranged at the second position by detaching the fold back portion from the fixed shaft, the front end portions of the attaching shaft portions are immersed into the end-piece.

In the wristwatch of the invention, a strap portion other than the end-piece of the strap may be constituted by rotatably connecting a plurality of strap blocks made of a metal, or constituted by a belt made of a material of natural skin or artificial skin or synthetic resin. According to the invention, a spring member comprising a round bar can preferably be used for an attaching member, and a shape of the fold back portion may be, for example, a U-like shape, V-like shape, further, may be a shape constituting O (ohm)-like shape along with the attaching shaft portion.

According to the wristwatch of the invention, the fold back portion of the attaching member can be fitted to the fixed shaft by bringing the end piece in a state of arranging the attaching member at the second position into the rod crotch between the contiguous rod legs of the case body, and rotating the attaching member by the hand to be moved to the first position. Thereby, the fold back portion is elastically deformed and the left and right pair of the attaching shaft portions are projected to both sides of the end-piece by passing the through holes in accordance with simultaneously pressing the pinching portions to be remote from each other. Further, the strap is attached to the case body by inserting the projected end portions into the attaching holes of the left and right pair of the rod legs opposed to the through holes at close distances. The attached state is held by elastically pinching the fixed shaft by the pinching portions of the fold back portion.

Contrary thereto, in the state of attaching the strap to the case body, by rotating the attaching member arranged at the first position by the hand to be moved to the second position, in accordance with making the pinching portions proximate to each other simultaneously with attaching the fold back portion of the fixed shaft, the left and right pair of the attaching shaft portions are moved to be immersed into the end-piece. Therefore, the strap can be detached from the case body by drawing out the attaching shaft portions from the attaching holes of the left and right pair of the rod legs. Further, in a state of detaching the strap from the case body, the attaching shaft portions can be held so as not to be projected to outside of the end-piece in a free state in which the attaching member of the strap is not elastically deformed, that is, in a no-load state.

According to a preferable mode of the wristwatch of the invention, a front end side portion of the fixed shaft is made to be bolder than a root side portion of the fixed shaft pinched by the pinching portions and therefore, it is preferable in view of capable of restraining the fold back portion of the attaching member arranged at the first position from being detached unpreparedly from the fixed shaft by the front end side portion of the fixed shaft.

According to a preferable mode of the wristwatch of the invention, a shape of the fold back portion in a free state is constituted by a U-like shape or a V-like shape and therefore, it is preferable in view of the fact that a bending shape thereof is simple and the attaching member is easy to be bent.

In order to resolve the above-described problem, a strap for a timepiece according to the invention is provided at a wristwatch a case body of which is provided with a rod leg forming a rod crotch and having an attaching hole, and having an end-piece connected to the case body attachably thereto and detachably therefrom by being received by the rod crotch to be able to be brought thereto and therefrom, wherein a recess portion is formed at a back face of the end-piece, through holes are respectively provided at side walls of the end-piece disposed on both sides of the recess portion, an attaching member including a fold back portion having pinching portions opposed to each other and capable of being elastically deformed in a direction of widening and a direction of narrowing an interval between the pinching portions, and attaching shaft portions rotatably inserted into the through holes by being folded to bend from the two pinching portions in directions of being remote from each other is contained in the recess portion movably between a first position and a second position by rotating the attaching member, a fixed shaft to and from which the fold back portion is attached and detached is provided at the recess portion to be shifted from a linear line connecting the two through holes, and when the attaching member is arranged at the first position, front end portions of the attaching shaft portions are projected to outside of the end-piece by widening the interval between the pinching portions by the fixed shaft pinched by the pinching portions of the fold back portion, and when the attaching member is arranged at the second position by detaching the fold back portions from the fixed shaft, the front end portions of the attaching shaft portions are immersed into the end-piece.

In the wristwatch of the invention, a strap portion other than the end-piece of the strap may be constituted by rotatably connecting a plurality of strap blocks made of a metal, or constituted by a belt made of a material of natural skin or artificial skin or synthetic resin. According to the invention, a spring member comprising a round bar can preferably be used for an attaching member, and a shape of the fold back portion may be, for example, a U-like shape, V-like shape, further, may be a shape constituting O (ohm)-like shape along with the attaching shaft portion.

In order to attach the strap for a timepiece of the invention to a case body of the wristwatch, the fold back portion of the attaching member may be fitted to the fixed shaft by bringing the end-piece in a state in which the attaching member is arranged at the second position to the rod crotch between the contiguous rod legs of the case body and thereafter rotating the attaching member by the hand to be moved to the first position. Thereby, the left and right pair of the attaching shaft portions are projected to both sides of the end-piece by passing the through holes in accordance with simultaneously pressing the pinching portion to be remote from each other by elastically deforming the fold back portion and therefore, the strap is attached to the case body by inserting the projected end portions into the attaching holes of the left and right pair of the rod legs opposed to the through holes at close distances. The attached state is held by elastically pinching the fixed shaft by the pinching portions of the fold back portion.

Contrary thereto, in order to detach the strap attached to the case body of the wristwatch, the attaching member arranged at the first position may be rotated by the hand to be moved to the second position. Thereby, the left and right pair of the attaching shaft portions are moved to be immersed into the end-piece in accordance with making the pinching portions proximate to each other simultaneously with detaching the fold back portion from the fixed shaft and therefore, the strap can be detached from the case body by drawing out the attaching shaft portions from the attaching holes of the left and right pair of the rod legs. Further, in a state of detaching the strap from the case body, the attaching shaft portions can be held so as not to be projected to outside of the end-piece in a free state in which the attaching member of the strap is not elastically deformed, that is, in a no-load state.

According to a preferable mode of the strap for a timepiece of the invention, a front end side portion of the fixed shaft is made to be bolder than a root side portion of the fixed shaft pinched by the pinching portions and therefore, it is preferable in view of capable of restraining the fold back portion of the attaching member arranged at the first position from being detached unpreparedly from the fixed shaft at the front end side portion of the fixed shaft.

According to a preferable mode of the strap for a timepiece of the invention, a shape of the fold back portion in a free state is constituted by a U-like shape or a V-like shape and therefore, it is preferable in view of the fact that a bending shape thereof is simple and the attaching member is easy to be bent.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

An embodiment of the invention will be explained in reference to FIG. 1 through FIG. 5.

Figure 1:
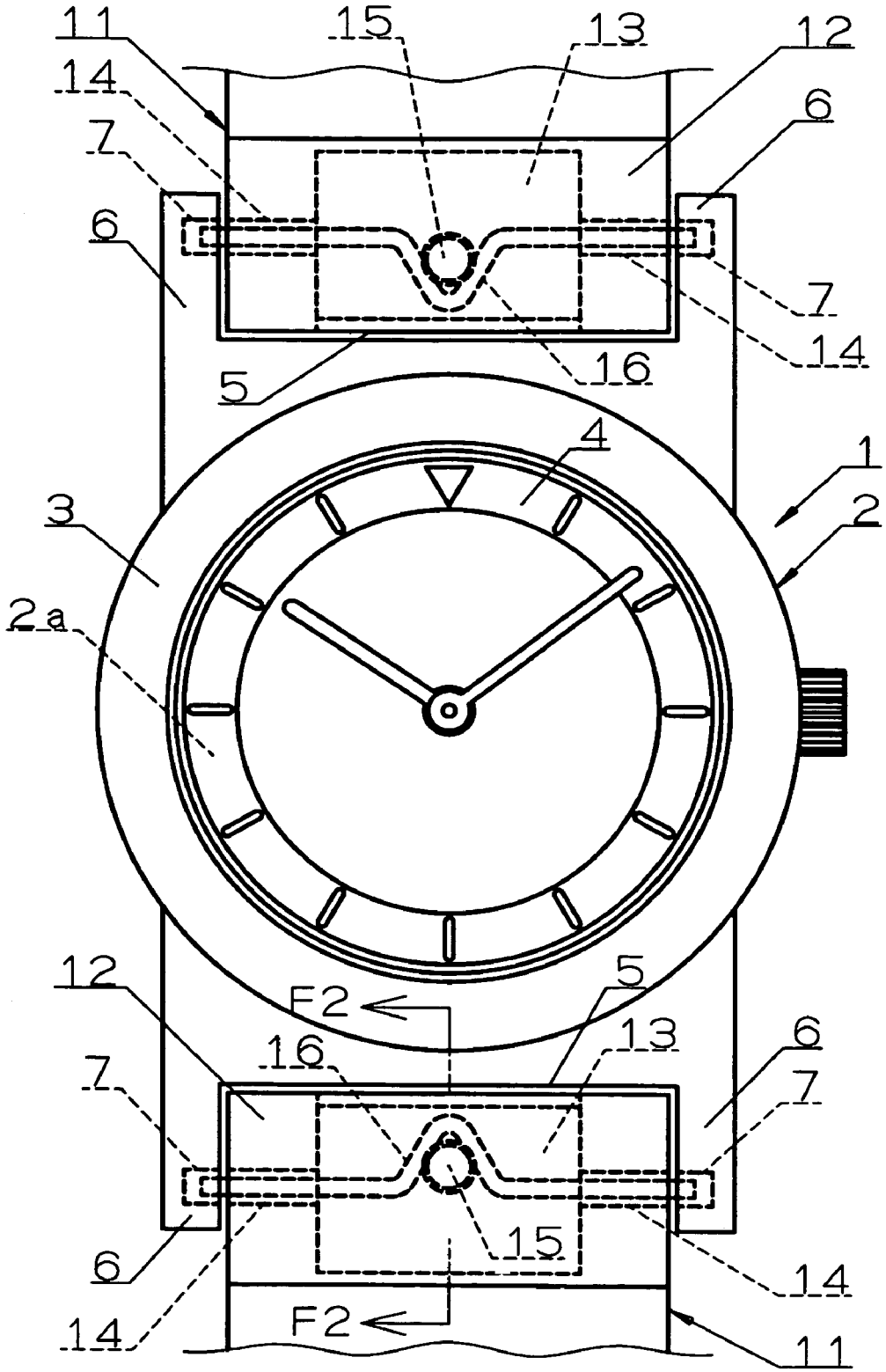
FIG. 1 is a front view showing a wristwatch according to an embodiment of the invention.

In FIG. 1, notation 1 designates a wristwatch. A dial 2*a* and a timepiece movement and the like, not illustrated, are contained at inside of a timepiece exterior assembly 2 provided to the wrist watch 1. The time piece exterior assembly 2 includes a case body 3 fabricated in a ring-like shape by a metal, a hard synthetic resin or the like. A cover glass 4 is mounted to one face (front face) in a thickness direction of the case body 3 in liquid tight, and a case back (not illustrated) is detachably mounted to other face (back face) in the thickness direction of the case body 3. The dial 2*a* is optically recognizable through the cover glass 4.

An outer side of the case body 3 is respectively provided with rod crotches 5 in correspondence with 12 o'clock-6 o'clock direction of the dial 2*a*. The rod crotches 5 are formed between left and right pairs of rod legs 6 projected integrally from an outer periphery of the case body 3. Each of the rod legs 6 is provided with an attaching hole 7 open to the rod crotch 5. The attaching holes 7 can also be provided by penetrating the rod leg 6 in a width direction thereof.

Notation 11 in FIG. 1 designates a strap constituting the wristwatch 1 along with the timepiece exterior assembly 2. The strap 11 includes an end-piece 12 made of a metal at one end portion thereof. In order to hold the wristwatch 1 by the wrist of a user, other end portions of the straps 11 are provided with coupling members (not illustrated) engageably and disengageably connected to each other.

Figure 2:
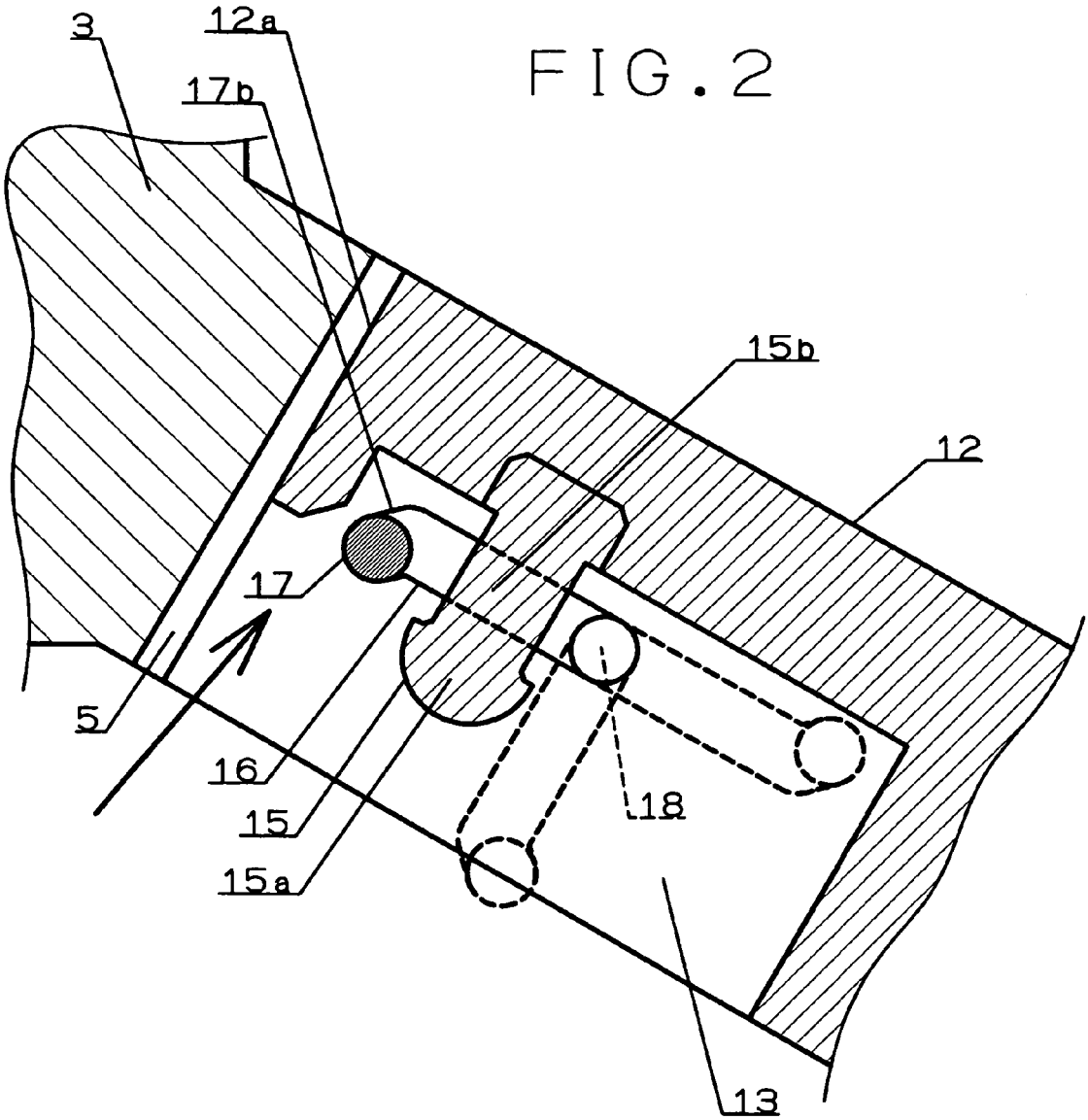
FIG. 2 is a sectional view shown in line with a line F2-F2 in FIG. 1.
Figure 3:
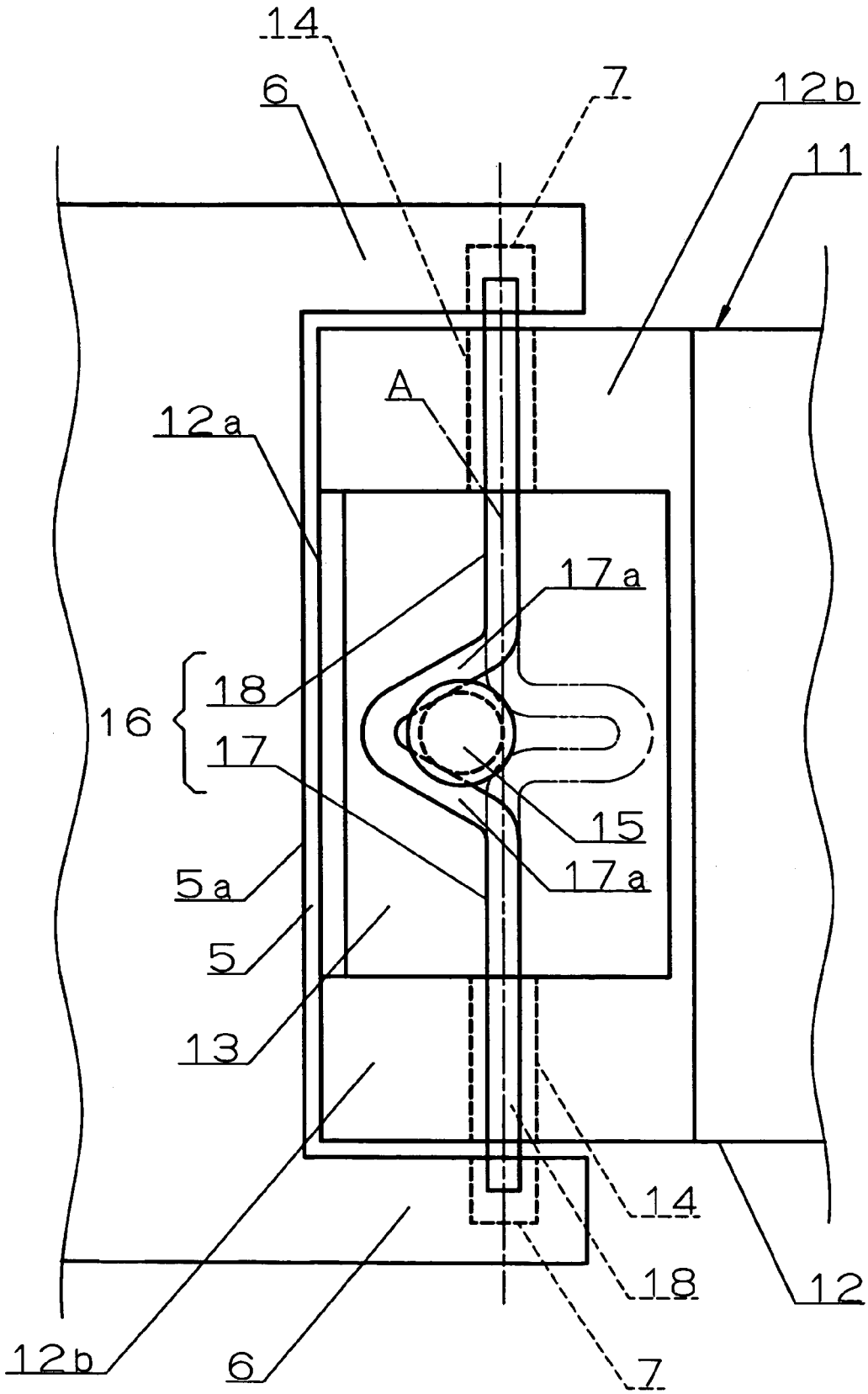
FIG. 3 is a rear view of a strap connecting portion showing a state of connecting a strap to a case body of the wristwatch of FIG. 1.
Figure 4:
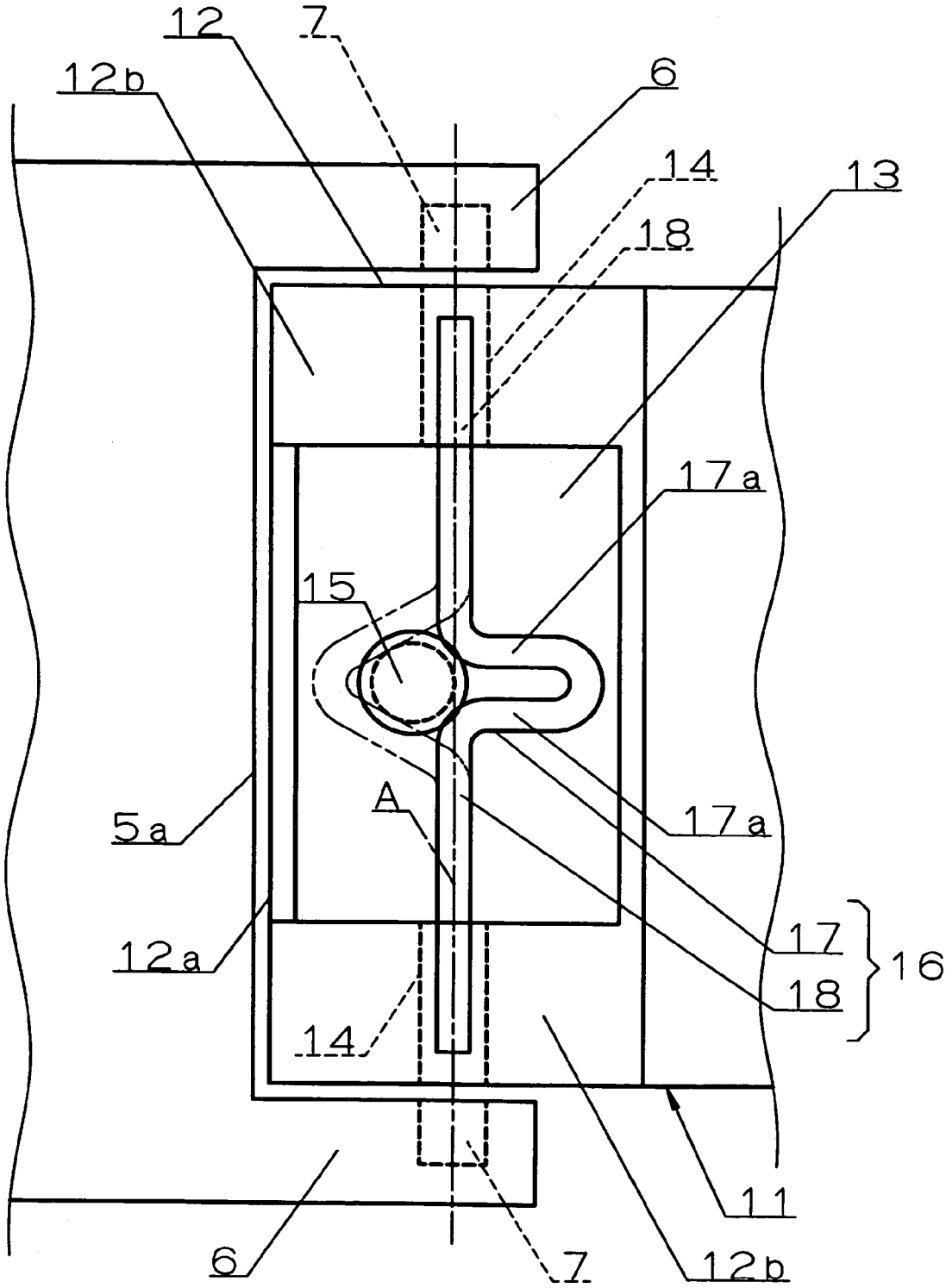
FIG. 4 is a rear view of the strap connecting portion showing a state of releasing the strap from being connected to the case body of the wristwatch of FIG. 1.

Back faces of the respective end-pieces 12 are formed with recess portions 13 in a shape of a square hole as shown by FIG. 2 through FIG. 4 and the like. The recess portion 13 is opened to the back face of the end-piece 12 and also opened to a front end face 12*a* of the end-piece 12. By opening the front end face 12*a*, it is preferable in view of capable of widely ensuring a space in erecting to operate a fold back portion 17 to an attaching member 16, mentioned later, up to a depth face 5*a* of the rod crotch 5. Respectives of side walls 12*b* of the end-pieces 12 disposed on two left and right sides of the recess portion 13 are provided with through holes 14 constituted by circular holes penetrating the side walls 12*b* in a width direction.

The recess portion 13 is attached with a fixed shaft 15 made of a metal projected from a bottom face thereof. The fixed shaft 15 is projected to be shifted from a linear line A connecting the left and right through holes 14 (shown in FIG. 3 and FIG. 4) to, for example, a front face opening side of the recess portion 13. A length of projecting the fixed shaft 15 from the bottom face of the recess portion 13 is shorter than a depth of the recess portion 13, further, the fixed shaft 15 is constituted by a circular shape in a front view thereof. A front end side portion 15*a* of the fixed shaft 15 is bolder than a root side portion 15*b* thereof. Further, a surface side face of the front end side portion 15*a* is made to constitute a semispherical shape. Along therewith, as shown by FIG. 2, a back side of the front end side portion 15*a* is made to constitute a taper shape by which a diameter thereof is gradually increased as proceeding to the surface side face as a preferable example and is continuous to the root side portion 15*b* without producing a stepped difference therebetween.

Figure 5A:
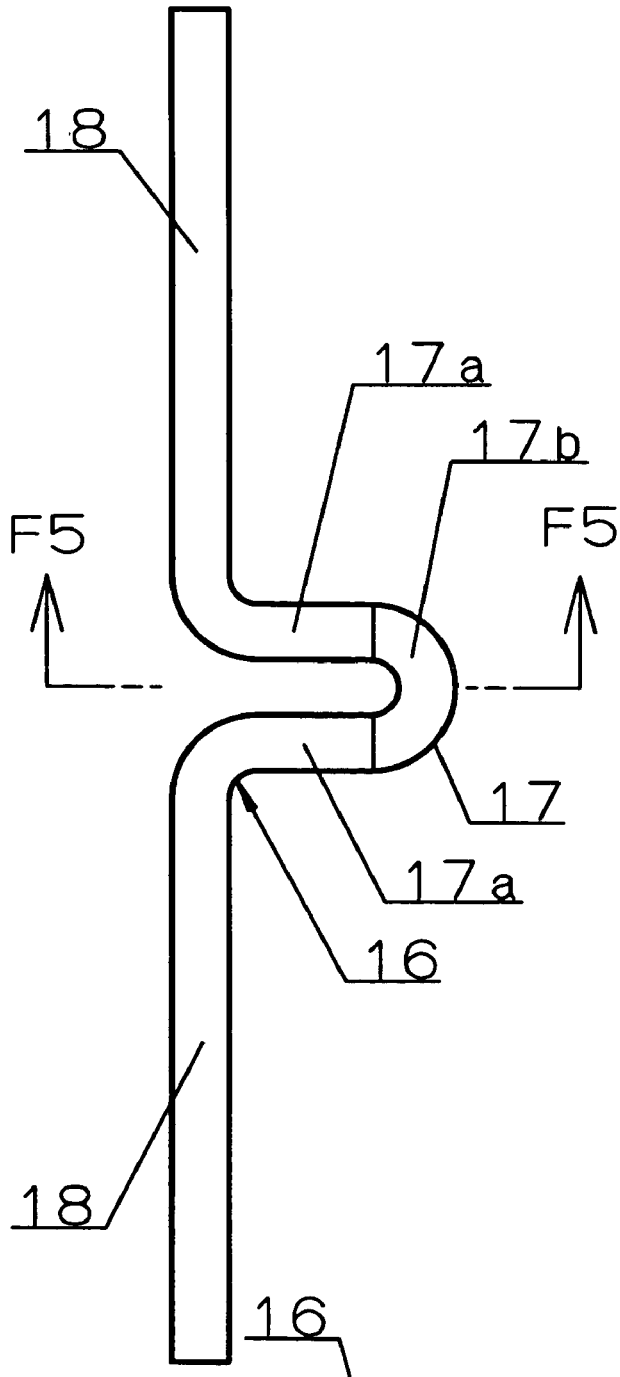
FIG. 5A is a plane view showing an attaching member provided to the strap of the wristwatch of FIG. 1.
Figure 5B:
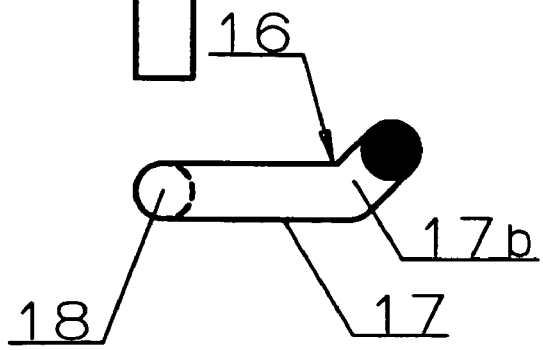
FIG. 5B is a sectional view taken along a line F5-F5 in FIG. 5A.

The attaching member 16 is contained in the recess portion 13. The attaching member 16 is produced by a spring bar made of a metal having a circular section. As shown by FIGS. 5A and 5B, the attaching member 16 includes the fold back portion 17 disposed at a center portion thereof, and attaching shaft portions 18 on both sides thereof.

The fold back portion 17 includes pinching portions 17*a* opposed to each other. The fold back portion 17 can elastically be deformed in a direction of widening and a direction of narrowing an interval between the pinching portions 17*a*. A shape of the fold back portion 17 shows a U-like shape as shown by a bold line in FIG. 4 in a free state and shows a V-like shape as shown by a bold line in FIG. 3 in a loaded state of being deformed elastically. The attaching shaft portions 18 are straight shaft portions and are folded to bend in directions of being remote from each other from ends of the respective pinching portions 17*a*, that is, both ends of the fold back portions 17.

The attaching member 16 is attached to the end-pieces 12 by containing respectives of the attaching shaft portions 18 to inside of the recess portion 13 in a state of inserting the attaching shaft portions 18 into the through holes 14 to be able to penetrate the through holes 14. The attaching member 16 is rotatable by constituting bearings by the through hole 14 in the attached state, and can be moved between a first position indicated by a bold line in FIG. 3 and a second position indicated by a bold line in FIG. 4 by rotating the attaching member 16. The fold back portion 17 is fitted to the fixed shaft 15 in a state of arranging the attaching member 16 at the first position. The fitting is released by moving the attaching member 16 to the second position and simultaneously therewith, the fold back portion 17 is held in a free state. Further, in accordance with the behavior, front end portions of the attaching shaft portions 18 are projected and immersed from and to the both side faces of the end-pieces 12 along the width direction of the end-pieces 12.

As shown by FIGS. 5A and 5B, a front end portion 17*b* of the fold back portion 17 is skewedly bent. Thereby, in a state of holding the fold back portion 17 at the first position, as shown by FIG. 2, the front end portion 17*b* is skewedly erected to the front end open end of the recess portion 13 and to the back face open end and therefore, the front end portion 17*b* is made to be easy to be operated to erect the attaching member 16 by using an article present close to oneself of a coin or the like.

A procedure of attaching the strap 11 to the case body 3 will be explained.

First, the attaching member 16 attached to the end-piece 12 is previously rotated to the second position. Under the state, the pinching portions 17*a* of the fold back portion 17 are proximate to each other the most, further, in accordance therewith, front end portions of the pair of attaching shaft portions 18 are arranged respectively at inside of the through hole 14 of the end-pieces 12 and are not projected to outside of the end-piece 12.

Next, as shown by FIG. 4, the end-piece 12 is arranged between the rod legs 6 contiguous to each other, that is, at inside of the rod crotch 5 of the case body 3. In the arranged state, the attaching hole 7 of the rod leg 6 and the through hole 14 of the end-piece 12 are brought into a state of being opposed to each other at a close distance. In this case, it is preferable that by pressing the front end face 12*a* of the end piece 12 to the depth face 5*a* of the rod crotch 5, the end-piece 12 can be positioned in 12 o'clock-6 o'clock direction of the dial 2*a*.

Finally, after erecting the attaching member 16 from the second position by the hand, the attaching member 16 is rotated to move down to the side of the case body 3 to be moved to the first position. Thereby, the fold back portion 17 of the attaching member 16 is fitted to the fixed shaft 15. In accordance with elastic deformation of the fold back portion 17 in accordance therewith, the pair of pinching portions 17*a* are pressed to be widened by the front end side portion 15*a* of the fixed shaft 15 in directions of being remote from each other, and pass the front end side portion 15*a* to thereby pinch the root side portion 15*b* elastically. Under the state, as shown by the bold line in FIG. 3, the fold back portion 17 is brought into a state of being opened in the V-like shape to be held at the second position and in accordance with pressing to widen the fold back portion 17, respectives of the attaching shaft portions 18 are projected from the through holes 17 to be simultaneously inserted into attaching holes 7 of the rod leg 6.

Therefore, the strap 11 is attached to the case body 3. The state is shown by bold lines in FIG. 1 and FIG. 2 and the bold line in FIG. 3. In the state of attaching the strap, as shown by FIG. 2, the fixed shaft 15 and the attaching member 16 are contained in the recess portion 13 without projecting from the back face of the end-piece 12 and therefore, there is not a concern of bringing the attaching member 16 into contact with the wrist of the user in a state of mounting the wristwatch 1, and even when the strap is assumedly brought into contact with the wrist, the contact is light and does not give a strange feeling and therefore, the feeling of use is excellent. Further, in addition to the fact that the fold back portion 17 of the attaching member 16 arranged at the first position elastically pinches the fixed shaft 15, the fold back portion 17 is caught by the front end side portion 15*a* of the fixed shaft 15 and therefore, even when an impact is applied to the wristwatch 1 in placing the wristwatch 1 detached from the wrist, it can further firmly prevented that the attaching member 16 moved down along the back face of the end-piece 12 to be arranged at the second position is unpreparedly detached from the fixed shaft 15.

A procedure of detaching the strap 11 from the case body 3 will be explained.

First, in the state shown by the bold line in FIG. 3, an article close to oneself of a coin or the like is inserted in a direction indicated by an arrow mark in FIG. 2 to be caught by the fold back portion 17 of the attaching member 16 arranged at the first position, the fold back portion 17 is rotated to erect and the attaching member 16 is arranged at the second position. In this case, first, the fold back portion 17 is more or less deformed elastically to be detached from the front end side portion 15*a* of the fixed shaft 15. At the time point, the fold back portion 17 is recovered to be brought into a free state by an elastic force thereof.

Thereby, the pinching portions 17*a* of the fold back portion 17 become proximate to each other and the fold back portion 17 is brought into the U-like shape and therefore, by the behavior, the front end portions of the respective attaching shaft portions. 18 are simultaneously detached from the attaching holes 7 and immersed into the through holes 14 so as not to be projected from the end-piece 12. The state is indicated by a bold line in FIG. 4.

Finally, by drawing out the end-piece 12 of the strap 11 from the rod crotch 5, the strap 11 can be detached from the case body 3.

As described above, in a state of arranging the end-piece 12 to the rod crotch 5, by rotating the attaching member 16 attached rotatably to the end-piece 12 by using a coin or the like close to oneself without requiring an exclusive tool to be arranged from the second position to the first position, the strap 11 can be attached to the case body 3. Contrary thereto, in a state of arranging the end-piece 12 to the rod crotch 5, by rotating the attaching member 16 by using a coin or the like to be arranged from the first position to the second position, the strap 11 can be detached from the case body 3.

Therefore, the wristwatch 1 having the above-described constitution is excellent in operability of assembling the strap 11 to the case body 3, and a user can easily attach and detach the end-piece 12 of the strap 11 to and from the case body 3. Therefore, when a user prepares to place one or more of the straps 11 having different designs each having the end-piece 12 provided with the fixed shaft 15 and the attaching member 16, the strap 11 can pertinently be interchanged to a desired one of the strap 11 easily by the above-described procedure and can be used by providing a change in the design to the wristwatch 1.

Further, according to the strap 11 detached from the case body 3, the attaching member 16 is brought into the free state, and the left and right attaching shaft portions 18 are held in a state of not being projected to outer sides along the width direction of the end-piece 12. Thereby, when the strap 11 is stored by itself, the attaching shaft portion 18 of the attaching member 16 does not constitute a hindrance of being caught by other object brought to a storing place and therefore, the handling performance in bringing in and out the strap 11 to and from the storing place can be promoted.

Further, since the attaching member 16 of the strap 11 detached from the case body 3 is brought into the free state and therefore, the attaching member 16 is held in a no load state in which the attaching member 16 is not elastically deformed. Therefore, there is not a concern of fatigue of spring performance of the attaching member 16 in storing the strap 11 over a long period of time.

According to the invention, there can be provided a wristwatch and a strap for a timepiece capable of promoting operability of attaching and detaching an end-piece to and from a rod leg and capable of promoting handling performance in being brought to and from a storing place.

What is claimed is:

1. A wristwatch comprising:

a case body projected with rod legs having attaching holes and formed with a rod crotch between the contiguous rod legs; and a strap being attachably and detachably connected to the case;

wherein a recess portion is formed at a back face of an end-piece of the strap received by the rod crotch to be able to be brought thereto and therefrom;

wherein through holes opposed to the attaching holes are respectively provided at side walls of the end-piece disposed on both sides of the recess portion in a state of receiving the end-piece at the rod crotch;

wherein an attaching member including a fold back portion having pinching portions opposed to each other and capable of being deformed elastically in a direction of widening and a direction of narrowing an interval between the pinching portions and attaching shaft portions rotatably inserted into the through holes by being folded to bend from the two pinching portions in directions of being remote from each other is contained at the recess portion movably between a first position and a second position by rotating the attaching member;

wherein a fixed shaft to and from which the fold back portion is attached and detached is provided at the recess portion to be shifted from a linear line connecting the two through holes; and wherein when the attaching member is arranged at the first position, front end portions of the attaching shaft portions are projected to outside of the end-piece by widening the interval between the pinching portions by the fixed shaft pinched by the pinching portions of the fold back portion, and when the attaching member is arranged at the second position by detaching the fold back portion from the fixed shaft, the front end portions of the attaching shaft portions are immersed into the end-piece.

2. A wristwatch according to claim 1; wherein a front end side portion of the fixed shaft is made to be bolder than a root side portion of the fixed shaft pinched by the pinching portions.

3. A wristwatch according to claim 1; wherein a shape of the fold back portion in a free state is constituted by a U-like shape or a V-like shape.

4. A strap for a timepiece comprising:

a strap for a timepiece provided at a wristwatch a case body of which is provided with a rod leg forming a rod crotch and having an attaching hole, and having an end-piece connected to the case body attachably thereto and detachably therefrom by being received by the rod crotch to be able to be brought thereto and therefrom;

wherein a recess portion is formed at a back face of the end-piece;

wherein through holes are respectively provided at side walls of the end-piece disposed on both sides of the recess portion;

wherein an attaching member including a fold back portion having pinching portions opposed to each other and capable of being elastically deformed in a direction of widening and a direction of narrowing an interval between the pinching portions, and attaching shaft portions rotatably inserted into the through holes by being folded to bend from the two pinching portions in directions of being remote from each other is contained in the recess portion movably between a first position and a second position by rotating the attaching member;

wherein a fixed shaft to and from which the fold back portion is attached and detached is provided at the recess portion to be shifted from a linear line connecting the two through holes; and wherein when the attaching member is arranged at the first position, front end portions of the attaching shaft portions are projected to outside of the end-piece by widening the interval between the pinching portions by the fixed shaft pinched by the pinching portions of the fold back portion, and when the attaching member is arranged at the second position by detaching the fold back portion from the fixed shaft, the front end portions of the attaching shaft portions are immersed into the end-piece.

5. A strap for a timepiece according to claim 4; wherein a front end side portion of the fixed shaft is made to be bolder than a root side portion of the fixed shaft pinched by the pinching portions.

6. A strap for a time piece according to claim 4; wherein a shape of the fold back portion in a free state is constituted by a U-like shape or a V-like shape.

* * * * *